US007067782B2

(12) United States Patent
Ochiai et al.

(10) Patent No.: US 7,067,782 B2
(45) Date of Patent: Jun. 27, 2006

(54) MAGNETRON

(75) Inventors: Hiroshi Ochiai, Tochigi (JP); Kazuhiko Miyamoto, Mooka (JP); Hiroshi Kanno, Utsunomiya (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/645,007

(22) Filed: Aug. 21, 2003

(65) Prior Publication Data

US 2004/0262304 A1 Dec. 30, 2004

(30) Foreign Application Priority Data

Jun. 30, 2003 (JP) ..... P. 2003-187740

(51) Int. Cl.
*H05B 6/72* (2006.01)
*H01J 23/15* (2006.01)

(52) U.S. Cl. ..... 219/761; 315/39.51

(58) Field of Classification Search ..... 219/761, 219/741, 746, 702; 315/5.13, 39.51, 85, 315/39.53, 39.75

See application file for complete search history.

(56) References Cited

U.S. PATENT DOCUMENTS

| | | | | | |
|---|---|---|---|---|---|
| 3,846,667 | A | * | 11/1974 | Hisada et al. | 315/39.53 |
| 3,922,612 | A | * | 11/1975 | Tashiro | 315/5.13 |
| 4,419,606 | A | * | 12/1983 | Tsuzurabara et al. | 315/39.51 |
| 5,432,405 | A | * | 7/1995 | Ochiai et al. | 315/39.51 |
| 2004/0070345 | A1 | * | 4/2004 | Yang | 315/39.51 |

FOREIGN PATENT DOCUMENTS

| | | | |
|---|---|---|---|
| JP | 57-17344 | | 4/1982 |
| JP | 7-240154 | | 9/1995 |
| JP | 8-7773 | | 1/1996 |
| JP | 08007773 | A * | 1/1996 |
| JP | 9-167570 | | 6/1997 |

* cited by examiner

*Primary Examiner*—Quang Van
(74) *Attorney, Agent, or Firm*—Pearne & Gordon LLP

(57) ABSTRACT

A magnetron that includes a choke coil which is connected at one end to a cathode terminal and at the other end to a capacitor to form an LC circuit. The choke coil is made up of a first core type inductor, a second core type inductor and an air-core inductor, connected to the cathode terminal, all of which are connected in series and where the first and second core type inductors are separated by a 1 mm to 6 mm gap. The first and second core type inductors have a bar like, high-frequency absorbing member located within their respective windings.

7 Claims, 5 Drawing Sheets

MAGNETRON

BACKGROUND OF THE INVENTION

The present invention relates to a magnetron in use for a high-frequency heating device, such as a microwave oven.

In a conventional magnetron, as shown in FIG. 5, a filter case 1 contains therein a choke coil 5, a cathode input wire 6, and a capacitor 7. The choke coil 5 is formed with a core type inductor 3 and a air-core inductor 4, which are connected in series. The core type inductor 3 has a high-frequency absorbing member 2 of a bar-like ferrite located within a winding thereof. The air-core inductor 4 does not have a high-frequency absorbing member in a winding thereof. The cathode input wire 6 is connected to a first end 5*a* of the choke coil 5, closer to the air-core inductor 4. The capacitor 7 has a capacitor terminal connected to a second end 5*b* of the choke coil 5, closer to the core type inductor 3.

In the magnetron, the air-core inductor 4 of the choke coil 5 is inserted between the cathode input wire 6 and the core type inductor 3 of the choke coil 5. This structure succeeds in solving a problem of insulation failure resulting from the burning of an insulating film coated on the winding of the choke coil 5, and another problem of the cracking of the high-frequency absorbing member 2 (see, for example, JP-B-57-017344<Japanese examined patent publication number: SHOU 57-17344>).

However, the conventional magnetron has a capability of attenuating only the noise at 400 MHz or lower even if the number of turns of the winding of the core type inductor 3 is adjusted, and further of attenuating only the noise within a range of 700 to 1000 MHz even if the number of turns of the winding of the air-core inductor 4 is adjusted. Therefore, there is a problem that the noise within a range from 500 to 700 MHz will interfere with communication radio waves.

SUMMARY OF THE INVENTION

Accordingly, an object of the present invention is to provide a magnetron which can attenuate the noise within the frequency range of 500 to 700 MHz with a simple construction.

According to the present invention, there is provided a magnetron having a choke coil which is connected between a cathode terminal and a capacitor, and cooperates with the capacitor to form an LC filter circuit. In the magnetron, the choke coil includes a series connection of first and second core type inductors and an air-core inductor. The first and second core type inductors having respectively bar-like high-frequency absorbing members located within windings thereof. The air-core inductor does not have a high-frequency absorbing member. The air-core inductor is connected to the cathode terminal. A gap having a width within 1 mm to 6 mm is present between the first core type inductor and the second core type inductor.

Such an arrangement succeeds in attenuating the noise in the frequency range from 500 to 700 MHz bands.

According to another aspect of the present invention, in the magnetron, frequency characteristics of those high-frequency absorbing members of the first and second core type inductors are different from each other.

With this aspect, it is possible to compositely attenuate the noise over a broad frequency band by selecting the sizes and materials of the high-frequency absorbing members according to a frequency band within where the noise attenuation is desired.

According to another aspect of the present invention, in the magnetron, one of the first and second core type inductors can be formed with a high-density wound type choke coil, and the other is formed with a low-density wound type choke coil.

With this aspect, the noise is attenuated over a broad frequency range by making the frequency characteristic of the first core type inductor different from that of the second core type inductor.

According to another aspect of the present invention, lengths of the first and second core type inductors are different from each other.

With this aspect, the frequency characteristics of those inductors can be different from each other, and the noise can be attenuated over a broad frequency range.

According to another aspect of the present invention, the high-frequency absorbing members located within windings of the first and second core type inductors are connected via an insulating material located on a position corresponding to the gap presented between the first and the second core type inductors, and the insulating material is made of a silicone rubber based material.

With this aspect, the two high-frequency absorbing members can be kept in a predetermined gap, and can be easily assembled within the windings. Furthermore, stable and high dielectric constant characteristic is obtained, and advanced mechanical endurance is obtained.

According to another aspect of the invention, the high-frequency absorbing members are fixed within the windings by fixing means made of a silicone rubber based adhesive.

With this aspect, the beat sounds generated by vibrations of the coil are prevented and the inductors are assembled without adverse effects to the dielectric constant characteristics of the inductors.

DESCRIPTION OF THE PREFERRED EMBODIMENT

The preferred embodiments of the present invention will be described with reference to the accompanying drawings.

Figure 1:
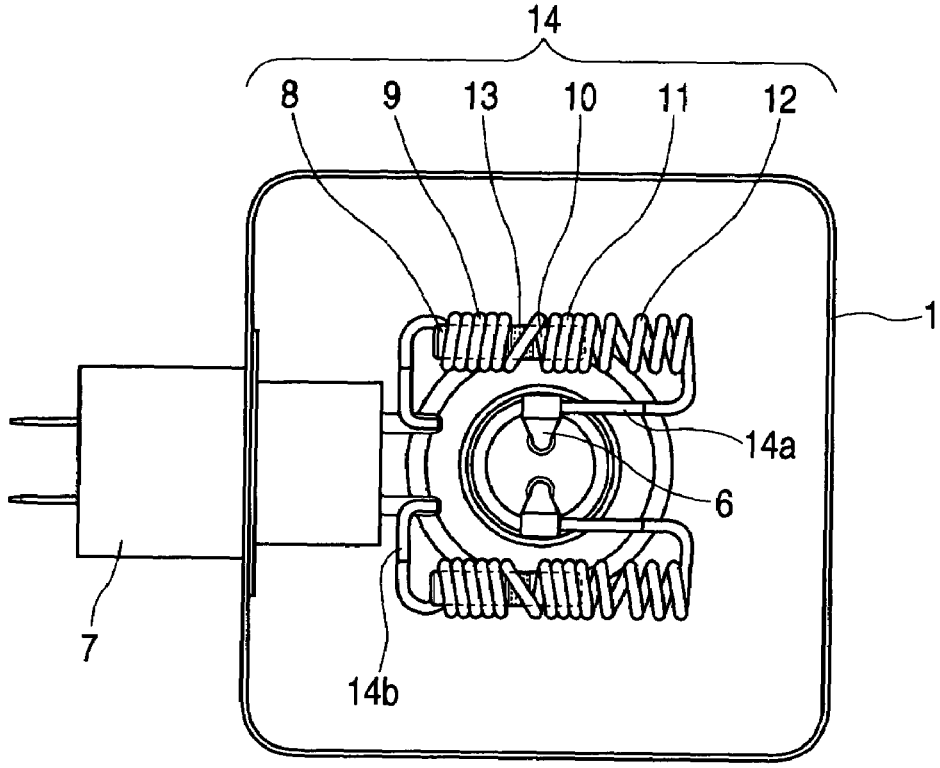
FIG. 1 is a plan view schematically showing an LC filter circuit arrangement of a magnetron according to the first embodiment of the present invention.
Figure 2A:
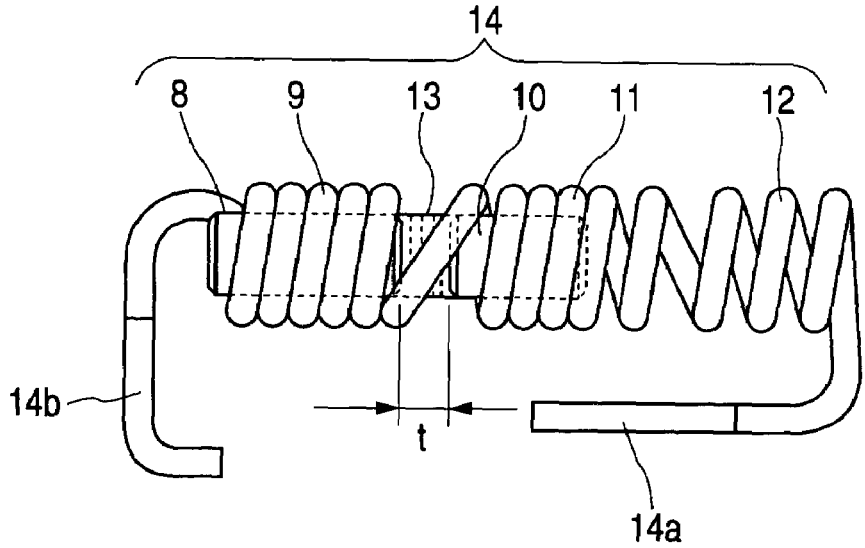
FIG. 2A is a front view showing a key part of a choke coil of the magnetron according to the first embodiment of the present invention.
Figure 3:
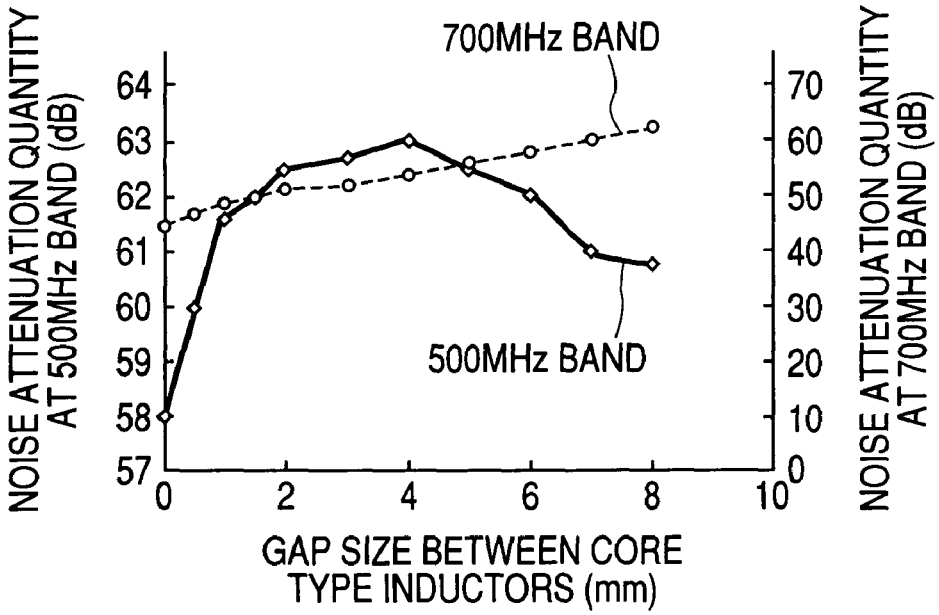
FIG. 3 is a graphical representation of variations of noise attenuation quantities at 700 MHz band and 500 MHz band with respect to a gap size of a gap between first and second core type inductors of the choke coil in the magnetron of the present invention.
Figure 4:
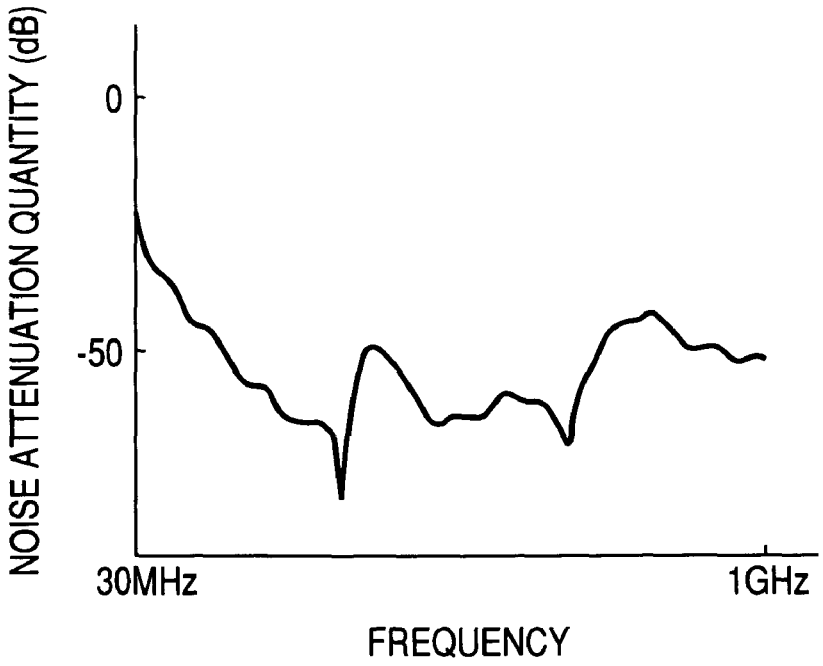
FIG. 4 is a graphical representation of a variation of noise attenuation quantity with respect to frequencies from 30 MHz to 1 GHz when the magnetron of the present invention is installed into a microwave oven.
Figure 5:
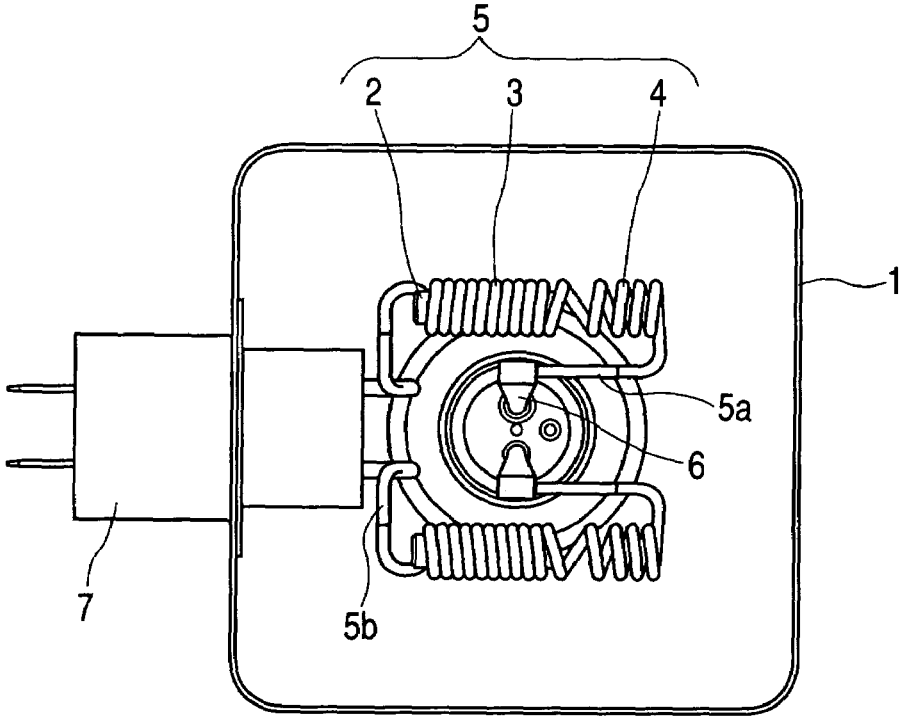
FIG. 5 PRIOR ART
FIG. 5 is a plan view schematically showing an LC filter circuit arrangement of a conventional magnetron.
Figure 6:
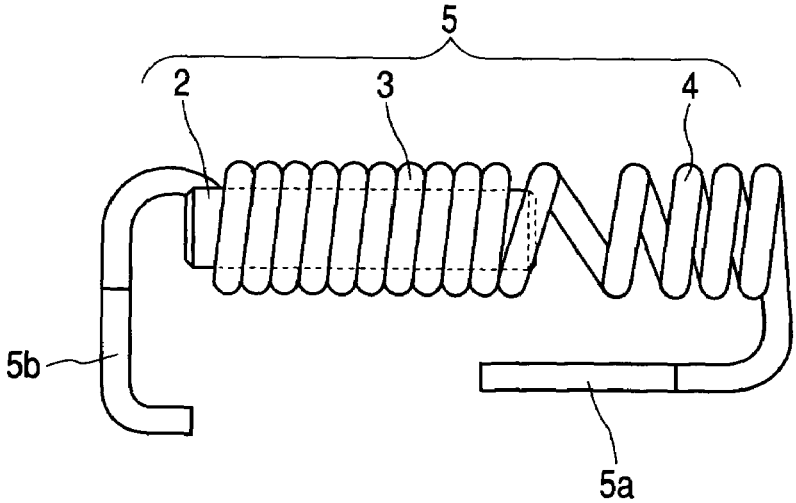
FIG. 6 PRIOR ART
FIG. 6 is a front view showing a key part of a choke coil of the conventional magnetron.

FIG. 1 is a plan view schematically showing an LC filter circuit arrangement of a magnetron of the first embodiment of the present invention. FIG. 2A is a front view showing a key part of a choke coil of the magnetron according to the first embodiment. FIG. 3 is a graphical representation of variations of noise attenuation quantities of a 700 MHz band and a 500 MHz band with respect to a gap size of a gap between first and second core type inductors of the choke coil in the magnetron according to the first embodiment. FIG. 4 is a graphical representation of a variation of noise attenuation quantity with respect to frequencies from 30 MHz to 1 GHz when the magnetron according to the first embodiment is installed into a microwave oven. Throughout the drawings to be referred to hereunder, portions which are the same as or equivalent to those described in the prior art description are designated by like reference numerals, for simplicity.

In the magnetron of the first embodiment, as shown FIG. 1 and FIG. 2A, a choke coil 14 contained in a filter case 1 of the magnetron includes a first core type inductor 9, a second core type inductor 11, and an air-core inductor 12, which are connected in series. The first core type inductor 9 has a first high-frequency absorbing member 8 formed with a bar-like ferrite, which is located within a winding thereof. The second core type inductor 11 has a second high-frequency absorbing member 10 within a winding thereof. The air-core inductor 12 does not have a high-frequency absorbing member within a winding thereof. In the choke coil 14, the first and second core type inductors 9, 11 are connected to each others via a gap within 1 mm to 6 mm (gap size: "t"=1–6 mm). Further, the first and second high-frequency absorbing members 8, 10 is connected to each others via an insulating material 13 made of, for example, a silicone rubber based material.

The gap size: "t" is defined as the gap length between the first and second high-frequency absorbing members 8, 10 in the above, however the gap size: "t" may be defined as the gap length between the winding of the first core type inductor 9 and the winding of the second core type inductor 11.

In the choke coil 14 thus constructed, one end 14*a* of the choke coil 14, positioned to the air-core inductor 12 side end, is connected to a cathode input wire 6. A second end 14*b* of the choke coil 14, positioned to the first core type inductor 9 side end, is connected to a terminal of a capacitor 7 mounted on the filter case 1.

If the first high-frequency absorbing member 8 and the second high-frequency absorbing member 10 are merely placed within the windings, respectively, the following problems will be created. By vibrations caused when the magnetron operates, the high-frequency absorbing members 8 and 10 will generate beat sounds. Further, those high-frequency absorbing members move within the windings, thereby failing to obtain noise attenuations at desired frequencies. To avoid those problems, in the invention, the insulating material 13 made of the silicone rubber based material is interposed between those high-frequency absorbing members.

Positional relationships between the first core type inductor 9 and the second core type inductor 11 of the choke coil 14 will be confirmed empirically.

FIG. 3 graphically shows relationships between noise attenuation quantities of 500 MHz and 700 MHz bands and a gap size "t" of the gap between the first and second core type inductors, in a magnetron according to the present invention configured in the above mentioned manner, in a state of a oscillating frequency is 2,450 MHz, a microwave output power is 1,000 W, the choke coil 14 is comprising windings made of a copper wire with 1.4 mm diameter coated with a heat-resistance resin film made of, for example, polyamideimide, and the high-frequency absorbing members 8, 10 made of ferrite bar having a relative permeability of about 100 and a relative dielectric constant of about 20. With regard to the noise attenuation quantity of the 500 MHz band (solid curve in FIG. 3), the noise attenuation quantity peaks when the gap size "t" is 4 mm, and its value is 63 dB. The noise attenuation quantity is 61.6 dB when the gap size "t" is 1 mm, and is 58 dB when it is 0 mm, viz., the first and second core type inductors 9, 11 are in contact with each other. Thus, when the gap size "t" decreases, in particular, from 1 mm to 0 mm, the noise attenuation quantity decreases sharply. Where the gap size "t" is increased, decrease of the noise attenuation quantity continues till the gap size "t" reaches 8 mm. Incidentally, the noise attenuation quantity is 62 dB when the gap size "t" is 6 mm, and is 61.2 dB when it is 8 mm. Thus, the magnetron has a noise attenuation characteristic depicted as a chevron shaped curve. With regard to a noise attenuation quantity of the 700 MHz band (broken curve in FIG. 3), when the gap size "t" is 0 mm, the noise attenuation quantity is 61.5 dB, and when it is 8 mm, the noise attenuation quantity is 63.2 dB. Thus, the noise attenuation quantity of the 700 MHz band gently increases from 0 mm (gap size) to 8 mm. As seen from the above facts, the noise attenuation effect of both the 500 MHz and 700 MHz bands are good within a range of the gap size "t" from 1 mm to 6 mm.

Figure 7:
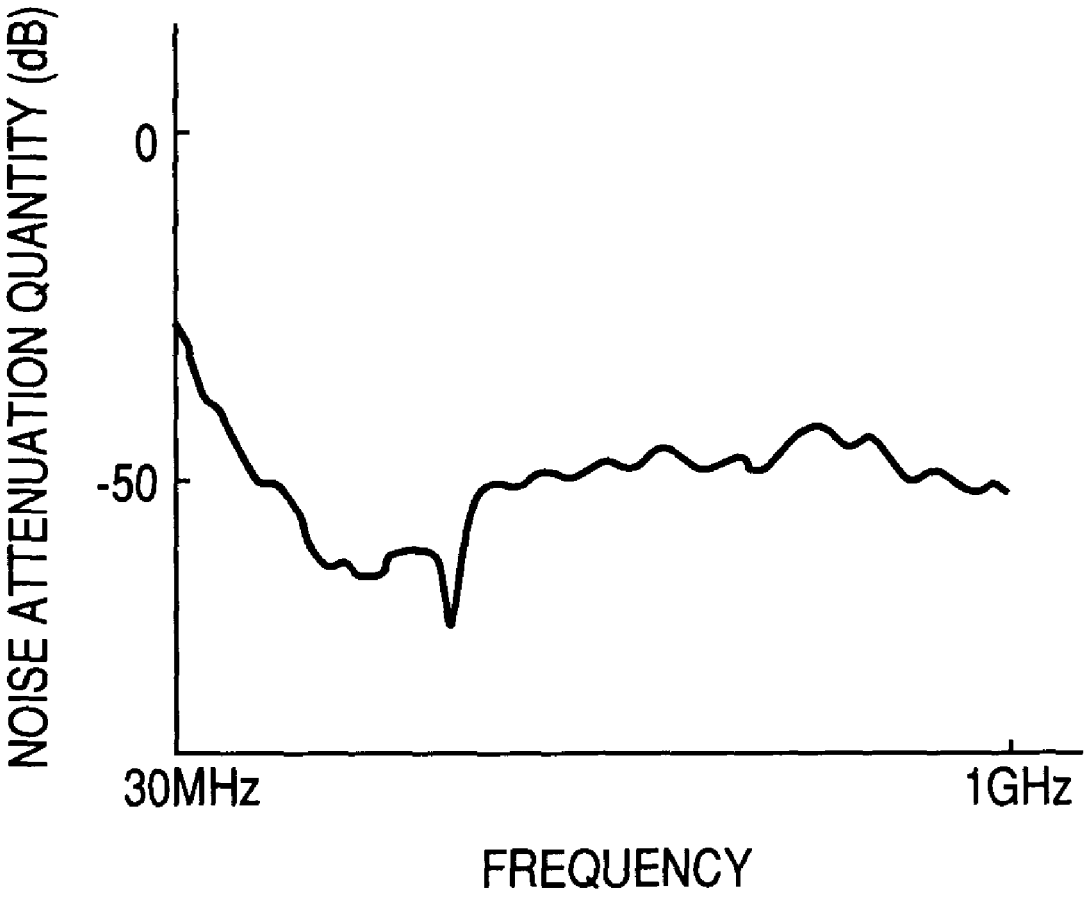
FIG. 7 PRIOR ART
FIG. 7 is a graphical representation of a variation of noise attenuation quantity with respect to frequencies from 30 MHz to 1 GHz when the conventional magnetron is installed into a microwave oven.

FIG. 4 shows noise attenuation quantities over a frequency range from 30 MHz to 1 GHz where the magnetron according to the present invention configured in the above mentioned manner and assembled into a home-use microwave oven. If compared the magnetron of the present invention as shown in the FIG. 4 to the conventional magnetron as shown in the FIG. 7, it is shown from that the magnetron of the present invention is more effective in attenuating the noise over the frequency range from the 500 MHz band to the 700 MHz band than the conventional one.

In general, a choke coil has a characteristic wherein if a permeability value of a high-frequency absorbing member located in the choke coil is bigger, an attenuating effect in lower frequency range becomes higher, since an impedance value becomes bigger, on the contrary, if a permeability value of a high-frequency absorbing member located in the choke coil is smaller, an attenuating effect in higher frequency range becomes higher, since an impedance value becomes smaller. Although, in the first embodiment of the present invention, the ferrite bar of the first high-frequency absorbing member 8 of the first core type inductor 9 is made of the same material as of the ferrite of the second high-frequency absorbing member 10 of the second core type inductor 11, and has a size equal to that of the latter. However, by selecting the sizes and/or materials of the high-frequency absorbing members 8, 10 according to frequency bands which are desired to be attenuated, and by making the frequency characteristics of those inductors 9, 11 to be different from each other, the noise can be attenuated over a broad frequency range.

Furthermore, in general, a choke coil has a characteristic wherein if a length of the choke coil is longer (a number of turns of a winding is larger), an attenuating effect in lower frequency range becomes higher, since an impedance value becomes bigger, on the contrary, if a length of the choke coil is shorter (a number of turns of a winding is smaller), an attenuating effect in higher frequency range becomes higher, since an impedance value becomes smaller. Hence, by selecting length (number of turns of a winding) of windings of the first and second core type inductors 9, 11 according to frequency bands which are desired to be attenuated, and by making the frequency characteristics of those inductors 9, 11 to be different from each other, the noise can be attenuated over a broad frequency range.

Figure 2B:
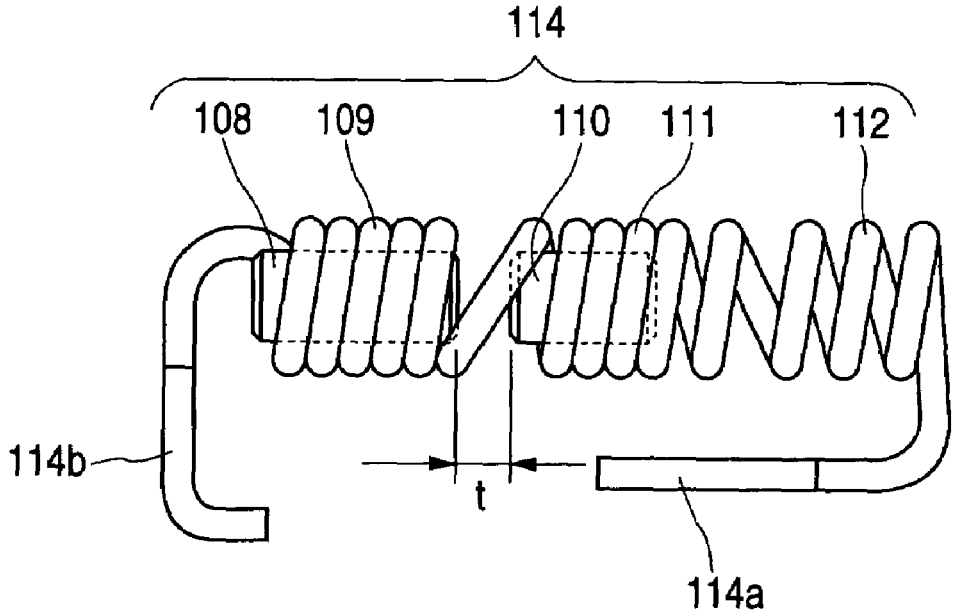
FIG. 2B is a front view showing a key part of a choke coil of a magnetron according to the second embodiment of the present invention.

FIG. 2B is a front view showing a key part of a choke coil of the magnetron according to the second embodiment. The choke coil 114 according to the second embodiment has the same construction as the choke coil 14 of the first embodiment, excepting no insulating material is provided between a first high-frequency absorbing member 108 of a first core type inductor 109 and a second high-frequency absorbing member 110 of a second core type inductor 111. Since a gap size "t" is set within 1 mm to 6 mm, the magnetron of the second embodiment has a good effective to attenuate a noise within the frequency range from 500 to 700 MHz bands, like the first embodiment.

In the second embodiment, the high-frequency absorbing members 108, 110 are fixed within the windings of the first and second core type inductors 109, 111, by fixing means (not shown) made of, for example, a silicone rubber based adhesive, and the high-frequency absorbing members 108, 110 are held in predetermined positions.

Figure 2C:
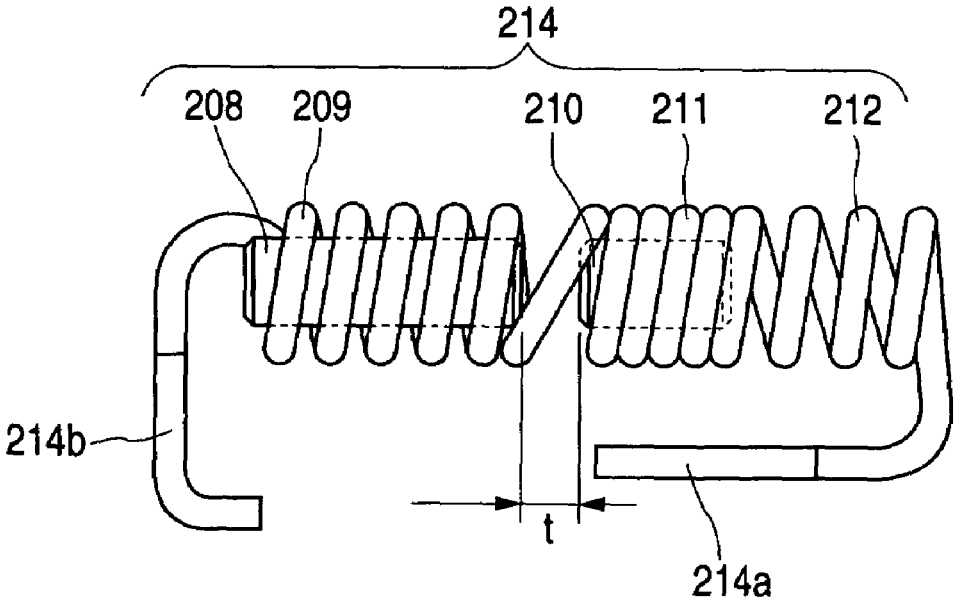
FIG. 2C is a front view showing a key part of a choke coil of a magnetron according to the third embodiment of the present invention.

FIG. 2C is a front view showing a key part of a choke coil of the magnetron according to the third embodiment. The choke coil 214 of the third embodiment comprises a first core type inductor 209 including a low-density wound type winding, a second core type inductor 211 including a high-density wound type winding, and an air-core inductor 212, which are connected in series. The first core type inductor 209 has a first high-frequency absorbing member 208 formed with a bar-like ferrite, which is located within the low-density wound type winding thereof. The second core type inductor 211 has a second high-frequency absorbing member 210 within the high-density wound type winding thereof. The air-core inductor 212 does not have a high-frequency absorbing member within a winding thereof. In the choke coil 214 of the third embodiment, the first and second core type inductors 209, 211 are connected to each other via a gap within 1 mm to 6 mm (gap size: "t"=1–6 mm).

In general, a choke coil has a characteristic wherein if a density of winding of the choke coil is lower, an attenuating effect in high frequency range becomes higher, since an impedance value becomes smaller, on the contrary, if a density of winding of the choke coil is higher, an attenuating effect in low frequency range becomes higher, since an impedance value becomes bigger.

Hence, in the third embodiment, by selecting densities of winding of the first and second core type inductors 209, 211 according to frequency bands which are desired to be attenuated, and by making the frequency characteristics of those inductors 209, 211 to be different from each other, the noise can be attenuated over a broad frequency range.

As seen from the foregoing description, according to the present invention, a choke coil which is connected between a cathode terminal and a capacitor of a magnetron, and cooperates with the capacitor to form an LC filter circuit, includes a series connection of first and second core type inductors and an air-core inductor, the first and second core type inductors having respectively bar-like high-frequency absorbing members located within windings thereof, the air-core inductor not having a high-frequency absorbing member, the air-core inductor is connected to the cathode terminal, a gap having a width within 1 mm to 6 mm is present between the first and second core type inductors. Use of the choke coil thus constructed reduces the noise within the frequency range from 500 to 700 MHz, which cannot be reduced by the conventional technique.

What is claimed is:

1. A magnetron comprising a choke coil connected between a cathode terminal and a capacitor, and cooperating with said capacitor to form an LC filter circuit, wherein said choke coil includes first and second core type inductors having respectively bar-like high-frequency absorbing members located within windings thereof, an air-core inductor not having a high-frequency absorbing member and connected to said cathode terminal;

said first core type inductor, said second core type inductor and said air-core inductor are connected in series, and;

said first core type inductor and said second core type inductor are arranged via a gap having a width within 1 mm to 6 mm;

wherein said high-frequency absorbing members located within said windings of said first and second core type inductors are connected via an insulating material located on a position corresponding to said gap presented between said first and the second core type inductors;

wherein said insulating material is made of a silicone rubber based material.

2. A magnetron comprising a choke coil connected between a cathode terminal and a capacitor, and cooperating with said capacitor to form an LC filter circuit, wherein said choke coil includes first and second core type inductors having respectively bar-like high-frequency absorbing members located within windings thereof, an air-core inductor not having a high-frequency absorbing member and connected to said cathode terminal;

said first core type inductor, said second core type inductor and said air-core inductor are connected in series, and;

wherein a first high-frequency absorbing member provided in said first core type inductor and a second high-frequency absorbing member provided in said second core type inductor are fixed within said windings of the first and second core type inductors by fixing means made of a silicone rubber based adhesive;

said first high-frequency absorbing member and said second high-frequency absorbing member are arranged via a gap having a width within 1 mm to 6 mm.

3. A magnetron according to claim 2, wherein frequency characteristics of said high-frequency absorbing members of said first and second core type inductors are different from each other.

4. A magnetron according to claim 2, wherein one of said first and second core type inductors is formed with a high-density wound type choke coil, and the other is formed with a low-density wound type choke coil.

5. A magnetron according to claim 2, wherein lengths of said first and second core type inductors are different from each other.

6. A magnetron according to claim 2, wherein said high-frequency absorbing members located within said windings of said first and second core type inductors are connected via an insulating material located on a position corresponding to said gap presented between said first and the second core type inductors.

7. A choke coil, for being connected between a cathode terminal and a capacitor, and cooperating with said capacitor to form an LC filter circuit of a magnetron, comprising;

first and second core type inductors having respectively bar-like high-frequency absorbing members located within windings thereof by fixing means made of a silicon rubber based adhesive, an air-core inductor not having a high-frequency absorbing member and connected to said cathode terminal, wherein said first core type inductor, said second core type inductor and said air-core inductor are connected in series and said second core type inductor is between said first core type inductor and said air-core inductor, and a first high frequency absorbing member of said first core type inductor and a second high frequency absorbing member of said second core type inductor are connected via a gap having a width within 1 mm to 6 mm.

* * * * *